US010808305B2

(12) United States Patent
Okonogi et al.

(10) Patent No.: US 10,808,305 B2
(45) Date of Patent: Oct. 20, 2020

(54) HIGH-STRENGTH PC STEEL WIRE

(71) Applicants: NIPPON STEEL & SUMITOMO METAL CORPORATION, Tokyo (JP); SUMITOMO ELECTRIC INDUSTRIES, LTD., Osaka (JP)

(72) Inventors: Makoto Okonogi, Tokyo (JP); Daisuke Hirakami, Tokyo (JP); Masato Yamada, Hyogo (JP); Katsuhito Oshima, Hyogo (JP); Shuichi Tanaka, Hyogo (JP)

(73) Assignees: NIPPON STEEL CORPORATION, Tokyo (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 348 days.

(21) Appl. No.: 15/745,755

(22) PCT Filed: Jul. 20, 2016

(86) PCT No.: PCT/JP2016/071265
§ 371 (c)(1),
(2) Date: Jan. 18, 2018

(87) PCT Pub. No.: WO2017/014232
PCT Pub. Date: Jan. 26, 2017

(65) Prior Publication Data

US 2018/0216213 A1 Aug. 2, 2018

(30) Foreign Application Priority Data

Jul. 21, 2015 (JP) ..... 2015-144062

(51) Int. Cl.
*C21D 9/52* (2006.01)
*C22C 38/32* (2006.01)
(Continued)

(52) U.S. Cl.
CPC ..... *C22C 38/32* (2013.01); *C21D 8/065* (2013.01); *C21D 8/08* (2013.01); *C21D 9/525* (2013.01);
(Continued)

(58) Field of Classification Search
CPC ..... C22C 38/32; C22C 38/24; C22C 38/16; C22C 38/06; C22C 38/001; C21D 9/525
See application file for complete search history.

(56) References Cited

FOREIGN PATENT DOCUMENTS

EP 2 832 878 2/2015
EP 2832878 A1 * 2/2015 ..... C21D 8/065
(Continued)

*Primary Examiner* — Christopher S Kessler
*Assistant Examiner* — Jiangtian Xu
(74) *Attorney, Agent, or Firm* — Clark & Brody LP

(57) ABSTRACT

This invention provides a high-strength PC steel wire having a chemical composition containing, in mass %, C: 0.90 to 1.10%, Si: 0.80 to 1.50%, Mn: 0.30 to 0.70%, P: 0.030% or less, S: 0.030% or less, Al: 0.010 to 0.070%, N: 0.0010 to 0.010%, Cr: 0 to 0.50%, V: 0 to 0.10%, B: 0 to 0.005%, Ni: 0 to 1.0%, Cu: 0 to 0.50%, and the balance: Fe and impurities. A ratio between the Vickers hardness ($Hv_S$) at a location (surface layer) that is 0.1D [D: diameter of steel wire] from the surface of the steel wire and the Vickers hardness ($Hv_I$) of a region on the inner side relative to the surface layer satisfies the formula [$1.10<Hv_S/Hv_I\leq1.15$]. An average carbon concentration in a region from the surface to a depth of 10 μm (outermost layer region) of the steel wire is 0.8 times or less a carbon concentration of the steel wire. The steel micro-structure in the region on the inner side relative to the outermost layer region contains, in area %, a pearlite structure: 95% or more. The tensile strength of the steel wire is 2000 to 2400 MPa. The method of producing
(Continued)

this high-strength PC steel wire is simple, and the high-strength PC steel wire is excellent in delayed fracture resistance characteristics.

4 Claims, 1 Drawing Sheet

(51) Int. Cl.

| | |
|---|---|
| ***C21D 8/08*** | (2006.01) |
| ***C22C 38/54*** | (2006.01) |
| ***C22C 38/00*** | (2006.01) |
| ***C21D 8/06*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***C22C 38/24*** | (2006.01) |
| ***E04C 5/08*** | (2006.01) |

(52) U.S. Cl.
CPC ..... *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/16* (2013.01); *C22C 38/24* (2013.01); *C22C 38/54* (2013.01); *E04C 5/08* (2013.01)

(56) References Cited

FOREIGN PATENT DOCUMENTS

| | | | | |
|---|---|---|---|---|
| JP | 07-268546 | | 10/1995 | |
| JP | 08-053737 | | 2/1996 | |
| JP | 2003-129177 | | 5/2003 | |
| JP | 2004-360005 | | 12/2004 | |
| JP | 2007-039799 | | 2/2007 | |
| JP | 2009-280836 | | 12/2009 | |
| JP | 2009280836 | A * | 12/2009 | |
| JP | 2014-136822 | | 7/2014 | |
| JP | 2014-136823 | | 7/2014 | |
| KR | 10-2014-0129239 | | 11/2014 | |
| WO | 2011/089782 | | 7/2011 | |
| WO | WO-2013146676 | A1 * | 10/2013 | ..... C22C 38/002 |

* cited by examiner

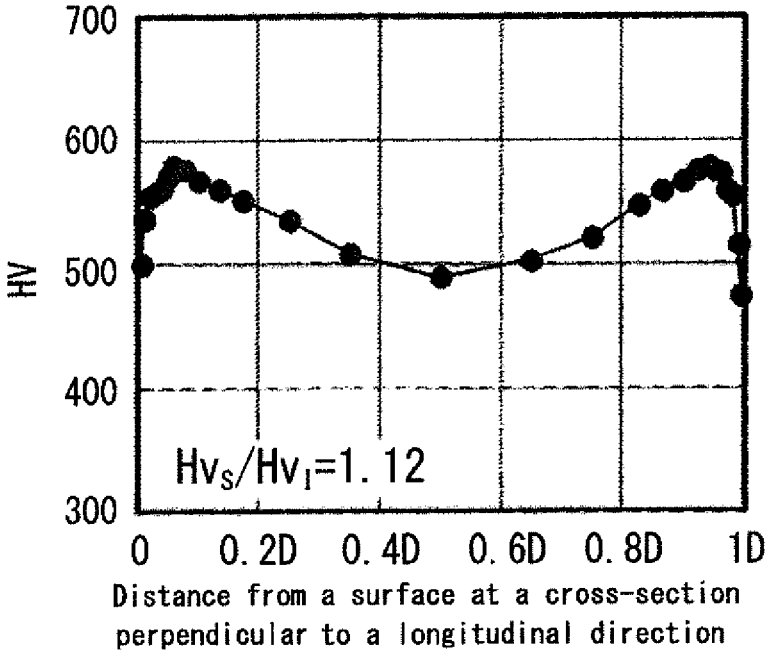
700
600
500
400
300
HV
Hvs/Hvl=1.12
0
0.2D
0.4D
0.6D
0.8D
1D
Distance from a surface at a cross-section perpendicular to a longitudinal direction

HIGH-STRENGTH PC STEEL WIRE

TECHNICAL FIELD

The present invention relates to a PC steel wire that is used for prestressed concrete and the like, and more particularly relates to a high-strength PC steel wire that has a tensile strength of 2000 MPa or more and has enhanced delayed fracture resistance characteristics.

BACKGROUND ART

A PC steel wire is mainly used for tendon of prestressed concrete to be used for civil engineering and building structures. Conventionally, a PC steel wire is produced by subjecting piano wire rods to a patenting treatment to form a pearlite structure, and thereafter performing wire-drawing and wire-stranding, and subjecting the obtained wire to an aging treatment in a final process.

In recent years, to decrease working costs and reduce the weight of structures, there is a demand for a high-strength PC steel wire having a tensile strength of more than 2000 MPa. However, there is the problem that delayed fracture resistance characteristics decrease accompanying enhancement of the strength of a PC steel wire.

Technology that has been proposed for improving the delayed fracture resistance characteristics of a PC steel wire includes, for example, as disclosed in JP2004-360005A, a high-strength PC steel wire in which, in a region to a depth of at least 1/10d (d represents the steel wire radius) of an outer layer of the steel wire, the average aspect ratio of plate-like cementites in pearlite is made not more than 30. Further, in JP2009-280836A, a high-strength PC steel wire is proposed in which, to make the tensile strength 2000 MPa or more, when the diameter of the steel wire is represented by D, the hardness in a region from the surface to a depth of 0.1D is made not more than 1.1 times the hardness in a region on the inner side relative to the region from the surface to a depth of 0.1D.

LIST OF PRIOR ART DOCUMENTS

Patent Document

Patent Document 1: JP2004-360005A
Patent Document 2: JP2009-280836A

SUMMARY OF INVENTION

Technical Problem

However, in the high-strength PC steel wire described in JP2004-360005A, because the tensile strength is less than 2000 MPa, the tensile strength is inadequate for use as a PC steel wire to be used for prestressed concrete and the like. Further, with regard to the high-strength PC steel wire described in JP2009-280836A, although the steel wire has a sufficient tensile strength, a special heat treatment is required in order to make the hardness in a region from the surface to a depth of 0. ID not more than 1.1 times the hardness in a region on the inner side relative to the region from the surface to a depth of 0.1D. That is, the production method disclosed in JP2009-280836A is complex and it is necessary to perform steps of: heating wire rods to 900° C. to 1100° C., and thereafter retaining the wire rods in a temperature range of 600 to 650° C. to conduct a partial pearlite transformation treatment, followed by holding the wire rods in a temperature range of 540° C. to less than 600° C.; performing hot finish rolling at 700 to 950° C. by hot rolling, and thereafter cooling to a temperature range of 500 to 600° C.; and holding the steel wire for 2 to 30 seconds in a temperature range of more than 450° C. to 650° C. or less after wire-drawing followed by a blueing treatment at 250 to 450° C.

The present invention has been made in view of the current situation that is described above, and an objective of the present invention is to provide a high-strength PC steel wire for which the production method is simple and which is excellent in delayed fracture resistance characteristics.

Solution to Problem

The present inventors conducted intensive studies to solve the above problem, and as a result obtained the findings described hereunder.

In order to improve delayed fracture resistance characteristics, the technology for high-strength PC steel wires proposed heretofore has focused on the micro-structure and hardness in a region from the surface of the steel wire to a depth of 1/20 of the wire diameter, or in a region from the surface of the steel wire to a depth of 1/10 of the wire diameter. The present inventors examined in detail the hardness distribution of a high-strength PC steel wire having a tensile strength of more than 2000 MPa, and as a result found that the hardness distribution has an M shape that is symmetrical around the center of the steel wire. Further, the present inventors concluded that, when the diameter of the steel wire is represented by "D", if the steel micro-structure in a region from the surface to a depth of 10 μm (hereunder, also referred to as "outermost layer region") of the aforementioned steel wire is controlled, even in a case where a ratio between a Vickers hardness at a location (hereunder, also referred to as surface layer) that is 0.1D from the surface of the steel wire and a Vickers hardness of a region on the inner side (hereunder, also referred to as "inner region") relative to the aforementioned surface layer is more than a ratio of 1.1 times, a high-strength PC steel wire that is excellent in delayed fracture resistance characteristics can be obtained.

In addition, the present inventors discovered that, to enhance the delayed fracture resistance characteristics of a PC steel wire, it is effective to lower the average carbon concentration of an outermost layer region. Since the starting point for the occurrence of a delayed fracture is the surface, a fracture toughness value at the surface is improved by lowering the average carbon concentration of the surface. It can be estimated that, as a result, the occurrence of cracks is suppressed and the delayed fracture resistance characteristics are enhanced.

However, on the other hand, if a layer in which the average carbon concentration is low is formed at the surface of a PC steel wire, although the delayed fracture resistance characteristics can be improved, the strength will not be sufficient. Therefore, a layer in which the average carbon concentration has been lowered is formed only at an outermost layer region of the steel wire, that is, the thickness of the layer in which the average carbon concentration has been lowered is made thin. By this means, it is possible to improve the delayed fracture resistance characteristics without causing a deterioration in the strength and twisting characteristics and the like.

That is, by making the average carbon concentration in the outermost layer region 0.8 times or less the average carbon concentration in the aforementioned steel wire and making an area fraction of a pearlite structure in a region on an inner side relative to the outermost layer region 95% or more, it is possible not to cause the delayed fracture resistance characteristics to deteriorate even if the strength of the steel wire is increased.

The present invention was made based on the above findings and has as its gist the high-strength PC steel wire described below.

(1) A high-strength PC steel wire, having a chemical composition containing, in mass %:

C: 0.90 to 1.10%,

Si: 0.80 to 1.50%,

Mn: 0.30 to 0.70%,

P: 0.030% or less,

S: 0.030% or less,

Al: 0.010 to 0.070%,

N: 0.0010 to 0.010%,

Cr: 0 to 0.50%,

V: 0 to 0.10%,

B: 0 to 0.005%,

Ni: 0 to 1.0%,

Cu: 0 to 0.50%, and the balance: Fe and impurities;

wherein:

when a diameter of the steel wire is represented by "D", a ratio between a Vickers hardness at a location 0.1D from a surface of the steel wire and a Vickers hardness of a region on an inner side relative to the location 0.1D from the surface of the steel wire satisfies formula (i) below;

an average carbon concentration in a region from the surface to a depth of 10 μm of the steel wire is 0.8 times or less a carbon concentration of the steel wire;

a steel micro-structure in a region on an inner side relative to a location 10 μm from the surface of the steel wire includes, in area %:

pearlite structure: 95% or more; and a tensile strength is 2000 to 2400 MPa;

$$1.10 < Hv_S/Hv_I \leq 1.15 \quad \text{(i)}$$

where, the meaning of each symbol in the formula (i) is as follows:

$Hv_S$: Vickers hardness of the location 0.1D from the surface of the steel wire;

$Hv_I$: Vickers hardness of the region on the inner side relative to the location 0.1D from the surface of the steel wire.

(2) The high-strength PC steel wire according to (1) above, wherein the chemical composition contains, in mass %, at least one element selected from Cr: 0.05 to 0.50%, V: 0.01 to 0.10%, and B: 0.0001 to 0.005%.

(3) The high-strength PC steel wire according to (1) or (2) above, wherein the chemical composition contains, in mass %, at least one element selected from Ni: 0.1 to 1.0%, and Cu: 0.05 to 0.50%.

Advantageous Effects of Invention

According to the present invention, a high-strength PC steel wire can be provided for which a production method is simple and which is excellent in delayed fracture resistance characteristics.

BRIEF DESCRIPTION OF DRAWINGS

FIG. 1 is a graph illustrating an example of a hardness distribution at a cross-section perpendicular to a longitudinal direction of a high-strength PC steel wire according to the present embodiment.

DESCRIPTION OF EMBODIMENTS

The present invention is described in detail hereunder. Note that, in the following description, the term "outermost layer region" refers to a region from the surface to a depth of 10 μm of the steel wire, the term "surface layer" refers to, when the diameter of a steel wire is represented by D, a location 0.1D from the surface of the steel wire, and the term "inner region" refers to a region on the inner side relative to the location 0.1D from the surface of the steel wire.

(A) Chemical Composition

In the high-strength PC steel wire of the present invention, the reasons for limiting the chemical composition are as follows. Note that, the symbol "%" with respect to content in the following description means "mass percent".

C: 0.90 to 1.10%

C is contained to secure the tensile strength of the steel wire. If the C content is less than 0.90%, it is difficult to secure the predetermined tensile strength. On the other hand, if the C content is more than 1.10%, the amount of proeutectoid cementite increases and the wire drawability deteriorates. Therefore the C content is made 0.90 to 1.10%. In consideration of compatibly achieving both high strength and wire drawability, the C content is preferably 0.95% or more, and is also preferably 1.05% or less.

Si: 0.80 to 1.50%

Si improves relaxation properties and also has an effect that raises the tensile strength by solid-solution strengthening. In addition, Si has an effect of promoting decarburization and thereby lowering the average carbon concentration in the outermost layer region. If the Si content is less than 0.80%, these effects are insufficient. On the other hand, if the Si content is more than 1.50%, the aforementioned effects are saturated, and the hot ductility also deteriorates and the producibility decreases. Therefore, the Si content is made 0.80 to 1.50%. The Si content is preferably more than 1.0%, and is also preferably 1.40% or less.

Mn: 0.30 to 0.70%

Mn has an effect of increasing the tensile strength of the steel after pearlite transformation. If the Mn content is less than 0.30%, the effect thereof is insufficient. On the other hand, if the Mn content is more than 0.70%, the effect is saturated. Therefore, the Mn content is made 0.30 to 0.70%. The Mn content is preferably 0.40% or more, and is also preferably 0.60% or less.

P: 0.030% or less

P is contained as an impurity. Because P segregates at crystal grain boundaries and causes the delayed fracture resistance characteristics to deteriorate, it is better to suppress the content of P in the chemical composition. Therefore, the P content is made 0.030% or less. Preferably, the P content is 0.015% or less.

S: 0.030% or Less

Similarly to P, S is contained as an impurity. Because S segregates at crystal grain boundaries and causes the delayed fracture resistance characteristics to deteriorate, it is better to suppress the content of S in the chemical composition. Therefore, the S content is made 0.030% or less. Preferably, the S content is 0.015% or less.

Al: 0.010 to 0.070%

Al functions as a deoxidizing element, and also has an effect of improving ductility by forming AlN and refining the grains, and an effect of enhancing the delayed fracture resistance characteristics by decreasing dissolved N. If the Al content is less than 0.010%, the aforementioned effects are not obtained. On the other hand, if the Al content is more than 0.070%, the aforementioned effects are saturated and the producibility is also reduced. Therefore, the Al content is made 0.010 to 0.070%. The Al content is preferably 0.020% or more, and is also preferably 0.060% or less.

N: 0.0010 to 0.0100%

N has an effect of improving ductility by forming nitrides with Al or V and refining the grain size. If the N content is less than 0.0010%, the aforementioned effect is not obtained. On the other hand, if the N content is more than 0.0100%, the delayed fracture resistance characteristics are deteriorated. Therefore, the N content is made 0.0010 to 0.0100%. The N content is preferably 0.0020% or more, and is also preferably 0.0050% or less.

Cr: 0 to 0.50%

Cr has an effect of increasing the tensile strength of the steel after pearlite transformation, and therefore may be contained if required. However, if the Cr content is more than 0.50%, not only will the alloy cost increase, but a martensite structure which is not wanted for the present invention is liable to arise, and will cause the wire-drawability and delayed fracture resistance characteristics to deteriorate. Therefore, the Cr content is made 0.50% or less. Preferably, the Cr content is 0.30% or less. Further, to sufficiently obtain the aforementioned effect, preferably the Cr content is 0.05% or more, and more preferably is 0.10% or more.

V: 0 to 0.10%

V precipitates as carbide VC and increases the tensile strength, and also forms VC or VN and these function as hydrogen-trapping sites, and hence V has an effect that enhances the delayed fracture resistance characteristics. Therefore, V may be contained if required. However, since the alloy cost will increase if the content of V is more than 0.10%, the V content is made 0.10% or less. Preferably, the V content is 0.08% or less. Further, to sufficiently obtain the aforementioned effect, the V content is preferably 0.01% or more, and more preferably is 0.03% or more.

B: 0 to 0.005%

B has an effect that increases the tensile strength after pearlite transformation, and an effect that enhances the delayed fracture resistance characteristics, and therefore may be contained if required. However, if B is contained in an amount that is more than 0.005%, the aforementioned effects are saturated. Therefore, the B content is made 0.005% or less. The B content is preferably 0.002% or less. Further, to sufficiently obtain the aforementioned effects, the B content is preferably 0.0001% or more, and more preferably is 0.0003% or more.

Ni: 0 to 1.0%

Ni has an effect of preventing hydrogen embrittlement by suppressing the penetration of hydrogen, and therefore may be contained if required. However, if the Ni content is more than 1.0%, the alloy cost will increase, and a martensite structure is also liable to be formed which will cause the wire-drawability and delayed fracture resistance characteristics to deteriorate. Therefore, the Ni content is made 1.0% or less. The Ni content is preferably 0.8% or less. Further, to sufficiently obtain the aforementioned effect, the Ni content is preferably 0.1% or more, and more preferably is 0.2% or more.

Cu: 0 to 0.50%

Cu has an effect of preventing hydrogen embrittlement by suppressing the penetration of hydrogen, and therefore may be contained if required. However, if the Cu content is more than 0.50%, the Cu will hinder hot ductility and the producibility will decrease, and a martensite structure is also liable to be formed which will cause the wire drawability and delayed fracture resistance characteristics to deteriorate. Therefore, the Cu content is made 0.50% or less. The Cu content is preferably 0.30% or less. Further, to sufficiently obtain the aforementioned effect, the Cu content is preferably 0.05% or more, and more preferably is 0.10% or more.

Balance: Fe and Impurities

The high-strength PC steel wire of the present invention has a chemical composition that contains the elements described above, with the balance being Fe and impurities. The term "impurities" refer to components which, during industrial production of the steel, are mixed in from raw material such as ore or scrap or due to various factors in the production process, and which are allowed within a range that does not adversely affect the present invention.

O is contained as an impurity in the high-strength PC steel wire, and is present as an oxide of Al or the like. If the O content is high, coarse oxides will form and will be the cause of wire breakage during wire-drawing. Therefore, the 0 content is preferably suppressed to 0.01% or less.

(B) Vickers Hardness $$1.10 < Hv_S/Hv_I \leq 1.15 \quad \text{(i)}$$

The high-strength PC steel wire of the present invention can improve delayed fracture resistance characteristics even when a ratio ($Hv_s/Hv_I$) between a Vickers hardness ($Hv_S$) of a surface layer and a Vickers hardness ($Hv_I$) of an inner region is more than 1.10. On the other hand, if $Hv_s/Hv_I$ is more than 1.15, the delayed fracture resistance characteristics of the high-strength PC steel wire will be poor. Accordingly, it is necessary for the high-strength PC steel wire of the present invention to satisfy formula (i) above.

FIG. 1 is a graph illustrating an example of the hardness distribution at a cross-section that is perpendicular to the longitudinal direction of the high-strength PC steel wire according to the present embodiment. As illustrated in FIG. 1, in the high-strength PC steel wire of the present invention, the hardness distribution has an M-shape that is symmetrical around the center (position at a distance of 0.5D from the surface) of the high-strength PC steel wire. Consequently, the high-strength PC steel wire is excellent in delayed fracture resistance characteristics.

Here, the term Vickers hardness ($Hv_I$) of an inner region means an average value of the hardness at a location at a depth of 0.25D and a location at a depth of 0.5D (center part) from the surface.

(C) Average Carbon Concentration

In the high-strength PC steel wire of the present invention, the average carbon concentration in an outermost layer region is 0.8 times or less the carbon concentration of the aforementioned steel wire. In this case, the carbon concentration of the aforementioned steel wire refers to the content of carbon contained in the aforementioned steel wire. When the average carbon concentration in the outermost layer region is made 0.8 times or less the carbon concentration of the aforementioned steel wire, even in a case where the ratio ($Hv_S/Hv_I$) between the Vickers hardness ($Hv_S$) of a surface layer and the Vickers hardness ($Hv_I$) of an inner region is more than 1.10, the delayed fracture resistance characteristics can be improved. The average carbon concentration in the outermost layer region is preferably 0.7 times or less the carbon concentration of the aforementioned steel wire.

Further, in the high-strength PC steel wire, if a region in which the average carbon concentration is 0.8 times or less the carbon concentration of the aforementioned steel wire is more than 10 μm from the surface, that is, if the region extends toward the center of the high-strength PC steel wire, the strength will decrease. Therefore, the aforementioned region is made a region from the surface of the high-strength PC steel wire to a depth of 10 pin. Note that the average carbon concentration can be measured using an electron probe microanalyzer (EPMA).

(D) Steel Micro-Structure

In the high-strength PC steel wire of the present invention, the area fraction of a pearlite structure in a region on the inner side relative to the outermost layer region, that is, in a region on the inner side relative to a location 10 μm from the surface of the steel wire, is 95% or more. If the area fraction of the pearlite structure in the region on the inner side relative to the outermost layer region is less than 95%, the strength decreases. Note that it is possible to measure the area fraction of the pearlite structure by observation of the high-strength PC steel wire by means of an optical microscope or an electron microscope.

(E) Tensile Strength

Tensile strength: 2000 to 2400 MPa

If the tensile strength of the high-strength PC steel wire is less than 2000 MPa, the strength of PC strands after wire stranding will be insufficient, and therefore it will be difficult to lower the execution cost and reduce the weight of construction. On the other hand, if the tensile strength of the high-strength PC steel wire is more than 2400 MPa, the delayed fracture resistance characteristics will rapidly deteriorate. Therefore, the tensile strength of the high-strength PC steel wire is made 2000 to 2400 MPa.

(F) Production Method

Although the production method is not particularly limited, for example, the high-strength PC steel wire of the present invention can be easily and inexpensively produced by the following method.

First, a billet having the composition described above is heated. The heating temperature is preferably 1170° C. to 1250° C. To reduce the average carbon concentration of the outermost layer region, it is preferable that a time period for which the billet surface is 1170° C. or higher be 10 minutes or more.

Thereafter, hot rolling is performed and the wire rod is coiled in a ring shape. The winding temperature is preferably 700 to 850° C. because, in the outermost layer region of the high-strength PC steel wire, the residence time in ferrite and austenite zones lengthens and decarburization is promoted, and this is effective for lowering the average carbon concentration in the outermost layer region.

After winding, the wire rod is immersed in a molten-salt bath to perform a pearlite transformation treatment. The cooling rate to 600° C. from the temperature after winding is preferably 30° C./sec or more, and the temperature of the molten-salt bath is preferably less than 500° C. In addition, to make the area fraction of the pearlite structure 95% or more in the region on the inner side relative to the outermost layer region, preferably, after the wire rod has been immersed once in a molten-salt bath having a temperature of less than 500° C., the wire rod is then retained for 20 seconds or more in a molten-salt bath having a temperature of 500 to 600° C. In order to change the immersion temperature in a molten-salt bath in this way, it is effective to utilize molten-salt baths that consist of two or more baths. Preferably, the total immersion time from the start of immersion to the end of immersion in the molten-salt bath is made 50 seconds or more.

Next, the wire rod that has undergone pearlite transformation is subjected to wire-drawing to impart strength thereto, and thereafter an aging treatment is performed. The wire-drawing is preferably performed so that the total reduction of area is 65% or more. Further, the aging treatment is preferably performed at 350 to 450° C.

The high-strength PC steel wire of the present invention can be produced by the above method.

The diameter of the obtained steel wire is preferably 3.0 mm or more, and more preferably is 4.0 mm or more. Further, the diameter is preferably not more than 8.0 mm, and more preferably is not more than 7.0 mm.

Hereunder, the present invention is described specifically by way of examples, although the present invention is not limited to the following examples.

EXAMPLES

Steel types "a" to "m" having the chemical compositions shown in Table 1 were heated and subjected to hot rolling under the conditions shown in Table 2, coiled into a ring shape, and immersed in a molten-salt bath at a rear part of the hot rolling line to perform a patenting treatment, and wire rods were produced. Thereafter, the obtained wire rods were subjected to wire-drawing until obtaining the wire diameters shown in Table 2, and were subjected to an aging treatment by heating after the wire drawing to produce the high-strength PC steel wires shown in test numbers 1 to 28. These steel wires were subjected to the following tests.

TABLE 1

| | Chemical Composition (mass %, balance: Fe and impurities) | | | | | | | | | | | | |
|---|---|---|---|---|---|---|---|---|---|---|---|---|---|
| Steel Type | C | Si | Mn | P | S | Al | N | Cr | V | B | Ni | Cu | O |
| a | 0.92 | 0.81 | 0.44 | 0.012 | 0.009 | 0.025 | 0.0026 | — | — | — | — | — | 0.001 |
| b | 0.93 | 1.22 | 0.46 | 0.009 | 0.011 | 0.032 | 0.0033 | 0.22 | — | — | — | — | 0.002 |
| c | 0.93 | 0.91 | 0.68 | 0.007 | 0.007 | 0.034 | 0.0036 | — | — | — | — | — | 0.002 |
| d | 0.95 | 1.07 | 0.42 | 0.009 | 0.012 | 0.032 | 0.0045 | — | — | — | — | — | 0.003 |
| e | 0.96 | 0.89 | 0.45 | 0.007 | 0.006 | 0.061 | 0.0041 | 0.16 | — | 0.001 | — | — | 0.002 |
| f | 0.96 | 1.25 | 0.40 | 0.012 | 0.009 | 0.032 | 0.0034 | 0.18 | 0.04 | — | — | — | 0.002 |
| g | 0.96 | 0.89 | 0.45 | 0.013 | 0.015 | 0.030 | 0.0042 | — | — | — | — | — | 0.002 |
| h | 0.98 | 0.91 | 0.45 | 0.009 | 0.009 | 0.031 | 0.0031 | 0.19 | — | 0.001 | — | — | 0.001 |
| i | 0.98 | 1.20 | 0.30 | 0.010 | 0.005 | 0.031 | 0.0034 | 0.19 | — | — | — | — | 0.001 |
| j | 0.99 | 0.88 | 0.41 | 0.005 | 0.004 | 0.029 | 0.0025 | 0.22 | 0.06 | — | — | — | 0.002 |
| k | 1.08 | 0.91 | 0.52 | 0.013 | 0.015 | 0.019 | 0.0024 | — | — | — | 0.2 | 0.13 | 0.002 |

TABLE 1-continued

| Steel Type | Chemical Composition (mass %, balance: Fe and impurities) | | | | | | | | | | | | |
|---|---|---|---|---|---|---|---|---|---|---|---|---|---|
| | C | Si | Mn | P | S | Al | N | Cr | V | B | Ni | Cu | O |
| l | 1.09 | 1.41 | 0.64 | 0.008 | 0.005 | 0.042 | 0.0027 | — | — | — | 0.7 | — | 0.001 |
| m | 0.92 | 0.56* | 0.45 | 0.009 | 0.007 | 0.033 | 0.0035 | — | — | — | — | — | 0.002 |

*indicates deviation from the range defined by the present invention.

TABLE 2

| Test Number | Steel Type | Heating Temperature (° C.) | Heating time for which slab outer layer is 1170° C. or more (min) | Coiling Temperature (° C.) | Cooling rate until 600° C. after coiling (° C./sec) | Molten-Salt Bath Temperature First Bath (° C.) | Molten-Salt Bath Temperature Second Bath (° C.) | Retention time in second molten-salt bath (sec) | Steel Wire Diameter (mm) | Reduction of Area in Wire-Drawing (%) | Heat Treatment Temperature after Wire-Drawing (° C.) |
|---|---|---|---|---|---|---|---|---|---|---|---|
| 1 | a | 1200 | 13 | 800 | 42 | 490 | 540 | 40 | 5.5 | 82.1 | 400 |
| 2 | b | 1210 | 14 | 780 | 41 | 480 | 540 | 43 | 5.0 | 85.2 | 400 |
| 3 | c | 1200 | 14 | 800 | 43 | 480 | 550 | 43 | 4.0 | 89.8 | 400 |
| 4 | d | 1180 | 12 | 820 | 44 | 480 | 550 | 37 | 4.5 | 87.0 | 400 |
| 5 | e | 1190 | 13 | 800 | 42 | 490 | 560 | 39 | 5.0 | 84.0 | 400 |
| 6 | f | 1180 | 13 | 830 | 42 | 490 | 560 | 42 | 5.0 | 86.3 | 400 |
| 7 | g | 1180 | 13 | 820 | 43 | 490 | 550 | 42 | 5.0 | 82.6 | 400 |
| 8 | h | 1180 | 12 | 830 | 45 | 480 | 540 | 40 | 5.0 | 82.6 | 400 |
| 9 | i | 1190 | 13 | 790 | 43 | 490 | 540 | 38 | 4.2 | 85.3 | 400 |
| 10 | j | 1180 | 12 | 810 | 42 | 490 | 560 | 44 | 5.0 | 83.9 | 400 |
| 11 | k | 1200 | 14 | 800 | 46 | 470 | 550 | 39 | 5.0 | 84.0 | 400 |
| 12 | l | 1200 | 14 | 800 | 44 | 490 | 540 | 31 | 5.2 | 82.7 | 400 |
| 13 | a | 1080 | — | 850 | 38 | 530 | 560 | 34 | 5.5 | 82.1 | 410 |
| 14 | b | 1080 | — | 850 | 38 | 530 | 550 | 37 | 5.0 | 85.2 | 410 |
| 15 | c | 1080 | — | 850 | 37 | 540 | 550 | 33 | 4.0 | 89.8 | 420 |
| 16 | d | 1080 | — | 850 | 32 | 550 | 550 | 36 | 4.5 | 87.0 | 410 |
| 17 | e | 1080 | — | 850 | 34 | 540 | 540 | 45 | 5.0 | 84.0 | 400 |
| 18 | f | 1080 | — | 850 | 30 | 560 | 560 | 32 | 5.0 | 86.3 | 410 |
| 19 | g | 1080 | — | 850 | 31 | 550 | 550 | 39 | 5.0 | 82.6 | 410 |
| 20 | h | 1080 | — | 850 | 33 | 530 | 540 | 38 | 5.0 | 82.6 | 410 |
| 21 | i | 1080 | — | 850 | 34 | 540 | 550 | 39 | 4.2 | 85.3 | 420 |
| 22 | j | 1080 | — | 850 | 31 | 550 | 550 | 43 | 5.0 | 83.9 | 400 |
| 23 | k | 1080 | — | 850 | 29 | 560 | 560 | 36 | 5.0 | 84.0 | 410 |
| 24 | l | 1080 | — | 850 | 31 | 550 | 560 | 36 | 5.2 | 82.7 | 400 |
| 25 | k | 1200 | 14 | 820 | 45 | 480 | 540 | 40 | 4.9 | 89.3 | 380 |
| 26 | l | 1200 | 14 | 820 | 46 | 480 | 540 | 42 | 4.8 | 87.4 | 370 |
| 27 | m* | 1200 | 14 | 830 | 45 | 480 | 550 | 30 | 5.3 | 80.5 | 400 |
| 28 | g | 1120 | — | 830 | 38 | 520 | 550 | 33 | 5.0 | 84.0 | 400 |

*indicates deviation from the range defined by the present invention.

A tensile strength test was performed using No. 9A test coupon in accordance with JIS Z 2241. The results are shown in Table 3.

A Vickers hardness test was performed in accordance with JIS Z 2244. When calculating the ratio ($Hv_S/Hv_I$) between the Vickers hardnesses, first the Vickers hardness ($Hv_S$) of the surface layer was measured with a test force of 0.98 N at locations that were at 8 angles at intervals of 450 at a cross-section perpendicular to the longitudinal direction of the steel wire and that were at a depth of 0.1D from the respective surface positions. The measurement values obtained at the 8 positions were averaged to determine $Hv_S$. Further, the Vickers hardness ($Hv_I$) of the inner region was measured with a test force of 0.98 N at a total of 9 locations at the 8 angles at which $Hv_S$ was measured and that included locations at a depth of 0.25D from the respective surface positions, and also a location at a depth of 0.5D (center part) from the surface. The measurement values obtained at the 9 locations were averaged to determine $Hv_I$. The calculated ratios ($Hv_S/Hv_I$) of the Vickers hardness are shown in Table 3.

The average carbon concentration in the outermost layer region was determined by performing line analysis using an electron probe microanalyzer (EPMA) with respect to regions that, at a cross-section perpendicular to the longitudinal direction of the steel wire, were at 8 angles at intervals of 450 and that were from the respective surface positions to a depth of 10 μm, and thereafter averaging the concentration distribution.

The area fractions of the steel micro-structure in a region on the inner side relative to the outermost layer region, that is, in a region on the inner side relative to a location at 10 μm from the surface of the steel wire at a cross-section perpendicular to the longitudinal direction of the steel wire were measured by using a scanning electron microscope (SEM) to photograph, at a magnification of 1000 times, areas of 125 μm×95 μm centering on a total of 17 places that were at 8 angles at 450 intervals starting from a position at which the area fraction of the pearlite structure was smallest and that included locations at a depth of 0.1D and locations at a depth of 0.25D from the respective surface positions as well as a location at a depth of 0.5D (center part), and then measuring the area values by image analysis. Thereafter, the obtained measurement values from the 17 positions were averaged to thereby determine the area fractions of the steel micro-structure in the region on the inner side relative to the outermost layer region. The results are shown in Table 3.

The delayed fracture resistance characteristics were evaluated by an FIP test. Specifically, the high-strength PC steel wires of test numbers 1 to 28 were immersed in a 20% $NH_4SCN$ solution at 50° C., a load that was 0.8 times of the rupture load was applied, and the rupture time was evaluated. Note that the solution volume to specimen area ratio was made 12 cc/cm$^2$. The FIP test evaluated 12 specimens for each of the high-strength PC steel wires, and the average value thereof was taken as the delayed fracture rupture time, and is shown in Table 3. The delayed fracture resistance characteristics depend on the tensile strength of the high-strength PC steel wire. Therefore, with respect to test numbers 1 to 24, test numbers 1 to 12 were compared with test numbers 13 to 24 for which the same steel types were used, respectively, and the delayed fracture resistance characteristics of a high-strength PC steel wire for which the delayed fracture rupture time was a multiple of two or more of the delayed fracture rupture time of the corresponding high-strength PC steel wire and for which the delayed fracture rupture time was four hours or more were determined as "Good". The delayed fracture resistance characteristics of high-strength PC steel wire that did not meet the above described conditions were determined as "Poor". Further, with respect to test numbers 25 to 28, because the delayed fracture rupture time was less than four hours, the delayed fracture resistance characteristics were determined as "Poor". The results are shown in Table 3.

TABLE 3

| Test Number | Steel Type | Tensile Strength (MPa) | $Hv_s/Hv_1$ | Average Carbon Concentration: Average Carbon Concentration of Outermost Layer Region (%) | Average Carbon Concentration: Average Carbon Concentration of Outermost Layer Region/Steel Wire Carbon Concentration | Region on Inner Side Relative to Outermost Layer Region Area Fraction of Pearlite Structure (%) | Delayed Fracture Resistance Characteristics: Delayed Fracture Rupture Time (Hours) | Delayed Fracture Resistance Characteristics: Evaluation | Remarks |
|---|---|---|---|---|---|---|---|---|---|
| 1 | a | 2073 | 1.11 | 0.63 | 0.68 | 96 | 94 | Good | Example |
| 2 | b | 2254 | 1.11 | 0.59 | 0.63 | 98 | 36 | Good | Embodiment of |
| 3 | c | 2287 | 1.13 | 0.61 | 0.66 | 97 | 31 | Good | Present |
| 4 | d | 2246 | 1.13 | 0.73 | 0.77 | 98 | 22 | Good | Invention |
| 5 | e | 2245 | 1.11 | 0.67 | 0.70 | 98 | 41 | Good | |
| 6 | f | 2277 | 1.11 | 0.72 | 0.75 | 99 | 27 | Good | |
| 7 | g | 2235 | 1.13 | 0.73 | 0.76 | 98 | 16 | Good | |
| 8 | h | 2254 | 1.12 | 0.77 | 0.79 | 98 | 9.7 | Good | |
| 9 | i | 2318 | 1.11 | 0.69 | 0.70 | 99 | 14 | Good | |
| 10 | j | 2329 | 1.12 | 0.75 | 0.76 | 99 | 8.9 | Good | |
| 11 | k | 2351 | 1.11 | 0.68 | 0.63 | 99 | 8.4 | Good | |
| 12 | l | 2390 | 1.11 | 0.69 | 0.63 | 99 | 8.5 | Good | |
| 13 | a | 2075 | 1.11 | 0.81 | 0.88* | 97 | 3.7 | Poor | Comparative |
| 14 | b | 2251 | 1.11 | 0.84 | 0.90* | 98 | 2.1 | Poor | Example |
| 15 | c | 2284 | 1.12 | 0.82 | 0.88* | 97 | 1.9 | Poor | |
| 16 | d | 2248 | 1.11 | 0.85 | 0.89* | 98 | 2.5 | Poor | |
| 17 | e | 2247 | 1.10* | 0.89 | 0.93* | 98 | 2.4 | Poor | |
| 18 | f | 2273 | 1.12 | 0.88 | 0.92* | 99 | 2.0 | Poor | |
| 19 | g | 2233 | 1.13 | 0.92 | 0.96* | 98 | 2.3 | Poor | |
| 20 | h | 2258 | 1.11 | 0.92 | 0.94* | 99 | 2.2 | Poor | |
| 21 | i | 2320 | 1.11 | 0.91 | 0.93* | 99 | 1.5 | Poor | |
| 22 | j | 2321 | 1.12 | 0.94 | 0.95* | 98 | 1.4 | Poor | |
| 23 | k | 2353 | 1.12 | 0.95 | 0.88* | 99 | 1.4 | Poor | |
| 24 | l | 2394 | 1.12 | 1.05 | 0.96* | 99 | 0.7 | Poor | |
| 25 | k | 2424* | 1.12 | 0.85 | 0.79 | 99 | 3.7 | Poor | |
| 26 | l | 2472* | 1.12 | 0.83 | 0.76 | 99 | 3.1 | Poor | |
| 27 | m* | 1990* | 1.11 | 0.82 | 0.89* | 97 | 3.8 | Poor | |
| 28 | g | 2249 | 1.27 | 0.76 | 0.79 | 99 | 4.2 | Poor | |

*indicates deviation from the range defined by the present invention.

For the high-strength PC steel wires of test numbers 1 to 12 that satisfied all the requirements defined according to the present invention, the delayed fracture rupture time was noticeably longer in comparison to the high-strength PC steel wires of test numbers 13 to 24 that deviated from the ranges defined in the present invention, and the delayed fracture resistance characteristics were good.

The high-strength PC steel wire of test number 27 was produced from a steel type m in which the Si content was lower than the range defined in the present invention, and hence the high-strength PC steel wire of test number 27 is a steel wire of a comparative example. When the Si content is lower than the range defined in the present invention, the tensile strength of the high-strength PC steel wire will be lower than the range defined in the present invention, and the average carbon concentration in the outermost layer region will deviate from the range defined in the present invention. Therefore, delayed fracture resistance characteristics of the high-strength PC steel wire of test number 27 were poor.

Further, in the high-strength PC steel wires of test numbers 13 to 24, the average carbon concentration in the outermost layer region deviated from the range defined in the present invention, and hence the high-strength PC steel wires of test numbers 13 to 24 are steel wires of comparative examples. Therefore, in the high-strength PC steel wires of test numbers 13 to 24, the delayed fracture resistance characteristics were poor.

In the high-strength PC steel wires of test numbers 25 and 26, the tensile strength was more than the range defined in the present invention, and hence the high-strength PC steel wires of test numbers 25 and 26 are steel wires of comparative examples. Therefore, in the high-strength PC steel wires of test numbers 25 and 26, the delayed fracture resistance characteristics were poor.

In the high-strength PC steel wire of test number 28, the ratio ($Hv_S/Hv_I$) between the Vickers hardness ($Hv_S$) of the surface layer and the Vickers hardness ($Hv_I$) of the inner region did not satisfy the aforementioned formula (i), and hence the high-strength PC steel wire of test number 28 is a steel wire of a comparative example. Therefore, in the high-strength PC steel wire of test number 28, the delayed fracture resistance characteristics were poor.

INDUSTRIAL APPLICABILITY

According to the present invention, a high-strength PC steel wire can be provided for which a production method is simple and which is excellent in delayed fracture resistance characteristics. Accordingly, the high-strength PC steel wire of the present invention can be favorably used for pre-stressed concrete and the like.

The invention claimed is:

1. A PC steel wire, having a chemical composition containing, in mass %,

C: 0.90 to 1.10%,
Si: 0.80 to 1.50%,
Mn: 0.30 to 0.70%,
P: 0.030% or less,
S: 0.030% or less,
Al: 0.010 to 0.070%,
N: 0.0010 to 0.010%,
Cr: 0 to 0.50%,
V: 0 to 0.10%,
B: 0 to 0.005%,
Ni: 0 to 1.0%,
Cu: 0 to 0.50%, and
the balance: Fe and impurities;

wherein:

when a diameter of the steel wire is represented by "D", a ratio between a Vickers hardness at a location 0.1D from a surface of the steel wire and a Vickers hardness of a region on an inner side relative to the location 0.1D from the surface of the steel wire satisfies formula (i) below;

an average carbon concentration in a region from the surface to a depth of 10 jam of the steel wire is 0.8 times or less a carbon concentration of the steel wire;

a steel micro-structure in a region on an inner side relative to a location 10 μm from the surface of the steel wire comprises, in area %:

pearlite structure: 95% or more; and a tensile strength is 2000 to 2400 MPa;

$$1.10<Hv_S/Hv_I\leq 1.15 \quad \text{(i)}$$

where, the meaning of each symbol in the formula (i) is as follows:

$Hv_S$: Vickers hardness at the location 0.1D from the surface of the steel wire, $Hv_I$: Vickers hardness of the region on the inner side relative to the location 0.1D from the surface of the steel wire.

2. The PC steel wire according to claim 1, wherein the chemical composition contains, in mass %, at least one element selected from Cr: 0.05 to 0.50%,
V: 0.01 to 0.10%, and
B: 0.0001 to 0.005%.

3. The PC steel wire according to claim 1, wherein the chemical composition contains, in mass %, at least one element selected from Ni: 0.1 to 1.0%, and
Cu: 0.05 to 0.50%.

4. The PC steel wire according to claim 2, wherein the chemical composition contains, in mass %, at least one element selected from Ni: 0.1 to 1.0%, and
Cu: 0.05 to 0.50%.

* * * * *